United States Patent [19]

Lapcevic

[11] Patent Number: 4,930,768

[45] Date of Patent: Jun. 5, 1990

[54] VARIABLE RESISTANCE WEIGHT LIFTING EXERCISE APPARATUS

[76] Inventor: Thomas G. Lapcevic, 244 Carriage Ct., Wayne, Pa. 19087

[21] Appl. No.: 269,517

[22] Filed: Nov. 10, 1988

[51] Int. Cl.[5] ..... A63B 21/06

[52] U.S. Cl. ..... 272/117; 272/118; 272/134

[58] Field of Search ..... 272/117, 118, 123, 134

[56] References Cited

U.S. PATENT DOCUMENTS

| | | | |
|---|---|---|---|
| 2,855,199 | 10/1958 | Noland et al. | 272/134 X |
| 4,405,128 | 9/1983 | Mclaughlin et al. | 272/134 X |
| 4,494,751 | 1/1985 | Schnell | 272/117 |
| 4,500,089 | 2/1985 | Jones | 272/117 |
| 4,502,681 | 3/1985 | Blomqvist | 272/117 X |
| 4,635,933 | 1/1987 | Schnell | 272/134 X |
| 4,666,149 | 5/1987 | Olschansky et al. | 272/134 X |
| 4,709,920 | 12/1987 | Schnell | 272/117 |
| 4,799,670 | 1/1989 | Williamson | 272/117 |
| 4,836,536 | 6/1989 | Jones | 272/134 |

*Primary Examiner*—Robert W. Bahr

*Attorney, Agent, or Firm*—Kirkpatrick & Lockhart

[57] ABSTRACT

A weight lifting exercise apparatus capable of multiple maximum and minimum segments of resistance force is provided. The apparatus disclosed includes a free-standing support frame within which a weight support carriage having detachable weight members is supported for vertical movement. A shaft is rotatably mounted on the frame and an exercise bearing member which may be engaged by a user is secured to the shaft as well as a cable wheel having a circular arc segment. A length of cable is secured at one end to the weight support carriage, reeved through cable guides and attached at its other end to the cable wheel. A fixed support disk is secured to the shaft and a first rotatable disk which supports a first torque arm is rotatably mounted on the shaft. The first torque arm supports a moveable weight and the first disk may be variably attached to the fixed disk. A second torque arm is also rotatably supported by the shaft, supports a second weight member and may be secured to the first disk. Because the initial positions of the first and second torque arms and weight members may be variably preselected, a myriad of resistance force patterns are available.

13 Claims, 4 Drawing Sheets

VARIABLE RESISTANCE WEIGHT LIFTING EXERCISE APPARATUS

BACKGROUND OF THE INVENTION

1. Field of the Invention

The present invention relates to weight lifting exercise devices and, in particular, to a weight lifting exercise device in which the weight resistance experienced by the user may be varied to control the segments of maximum and minimum resistance throughout the exercise movement.

2. Description of the Prior Art

It has been discovered that in developing certain body muscles by weight lifting, it is desirable that those muscles be subjected to a maximum resistance at selected segments in the exercise movement. However, most prior exercise apparatuses do not achieve a variance resistance during the exercise movement and only provide a constant resistance during the exercise. As used herein, "resistance force" will be taken to mean that force which must be overcome by the user in completing the initial one-half of the exercise movement or cycle.

In the field of weight lifting exercise apparatus, the most basic form of apparatus comprises an elongated tubular bar having a predetermined amount of weight in the form of weight members attached to the opposite ends thereof. To exercise with such apparatus, the user grasps the elongated bar and lifts the apparatus throughout a predetermined exercise movement. However, because the only force resisting the exercise movement is gravity which exerts a downward force of constant magnitude, the user experiences a constant resistance throughout the exercise movement.

As is known, the art has addressed the undesirability of requiring the user to manually attach and detach the weight members from the elongated bar by providing a mechanized apparatus which facilitates weight selection. Such an apparatus, referred to herein as a "standard" weight lifting exercise apparatus, typically includes a main support frame having upright members interconnected with crossmembers, a weight support carriage vertically movable within the main frame and having means for detachably supporting weight members; a cable guide means fixed to the main frame; a length of cable secured at one end to the weight support carriage and reeved about the cable guide means; and a gripping means such as a handle which is secured to the free end of the cable which may be grasped by the user to transmit force to vertically move the weight support carriage. It will be appreciated, however, that the resistance experienced by the user is the constant downward force of gravity on the weight support carriage. As such, the resistance is constant throughout the exercise movement and does not vary to achieve the benefits of maximum resistance at selected segments of the exercise movement which are discussed above.

In an alternative embodiment of the "standard" exercise apparatus, the free end of the cable is attached to a circular cable wheel which is attached to a rotatable shaft supported on the main support frame. A bearing surface or surfaces, such as leg extension pads, are also attached by means of a bracket to the rotatable shaft in order that the user may apply force against the bearing surfaces to rotate the shaft and, hence, the cable wheel, against the force of gravity on the weight support members which acts against the cable. Although the resistance experienced by the user is the resistance of rotating the bearing surfaces, such resistance is constant because the cable wheel is circular and the force created by the weight support carriage provides a moment arm of constant radius which acts constantly against the cable wheel.

In an effort to provide a certain degree of variable resistance in the last-described apparatus, the cable wheel may be replaced by a cam wheel which is rotatably mounted on the shaft and which has the cable attached thereto. Thus, the torque resistance experienced by the user may have a selected maximum and minimum point which is determined by the shape of the cam wheel which serves to present differing moment arms which are acted upon by the constant force applied to the cable by the weight support carriage. However, because the resistance pattern is determined by the shape of the cam wheel, in order to present alternative resistance patterns, the cable must be detached from the cam wheel, the cam wheel removed from the shaft and replaced by a different cam wheel, and the cable attached to the replacement cam wheel. In addition to the time and effort required in changing cam wheels, to provide varying resistance patterns, a plurality of cam wheels is required.

In an effort to provide a weight lifting exercise apparatus which may provide a plurality of resistance patterns the, invention of U.S. Pat. No. 4,753,437 issued June 28, 1988 to Dr. Paul S. Lapcevic was developed. Such apparatus includes all of the components of the "standard" apparatus described hereinabove as well as a resistance converter assembly supported by the main frame and secured to the weight support carriage for varying the resistance force on the weight support carriage as the carriage is vertically moved. The resistance converter disclosed therein includes an elongated beam member having a drag weight housing, one end of which is pivotally secured to the weight support carriage, and a bearing secured by vertical members of the main frame and supporting the beam member for rectilinear movement in response to the vertical movement of the weight support carriage. As such, the vertical movement of the weight support carriage is also resisted by the weight applied to the drag weight housing so that when the beam member is in a nonvertical position, the user must also move the drag weight up an inclined plane. Because the vertical position of the bearing member is preselected, the resistance force experienced by the user may have its maximum or minimum value predetermined along the exercise movement. However, such apparatus may only provide maximum and minimum resistance forces at the beginning or end, or both, of the initial one-half of the exercise cycle, but not at other segments therebetween.

The subject invention is directed toward an improved weight lifting exercise apparatus which overcomes, among others, the problems of prior art apparatuses and which provides an exercise apparatus in which a plurality of maximum and minimum resistance force segments may be readily provided during the exercise movement.

SUMMARY OF THE INVENTION

In accordance with the present invention, there is provided a weight lifting exercise apparatus in which multiple maximum and minimum segments of resistance force may be provided. The exercise apparatus disclosed includes a free standing support frame having interconnected vertical and horizontal framework members. A weight support carriage is supported within the support frame for vertical movement along guide bars. The weight support carriage includes a plunger bar means for detachably supporting weight members. In addition, a shaft is rotatably attached to the frame and an exercise bearing member to which the user applies the exercise force is secured to the shaft by a bracket, as well as a cable wheel having a circular arc segment. Cable guide means are fixed to the main frame. A length of cable is secured at one end to the weight support carriage and at its other end to the cable wheel while the cable is reeved about the cable guide means.

At one end of the rotatable shaft there is attached a fixed support disk which has a plurality of holes provided adjacent its outer circumference. In addition, a first disk also having a plurality of holes therethrough is rotatably supported on the shaft adjacent to the first disk. A first torque arm is secured to the first disk. The first torque arm has a plurality of apertures along its length which serve to fix the position of a first displaceable weight member along the first shaft. Pin means are provided for securing the first disk to the fixed disk by passing through corresponding apertures therein. Further, a second torque arm is rotatably supported by the shaft adjacent to the first disk. The second torque arm is also provided with a plurality of apertures along its length in order that a second weight member may be attached along its length. Pin means are also provided for fixing the second torque arm to the first disk.

In the operation of the subject apparatus, the torque arms and their corresponding weight members serve to increase or decrease the resistance force encountered by the user in the exercise motion as compared to the weight selected in the weight support carriage. For example, if the exercise motion causes the shaft to rotate in a counterclockwise direction and the first torque arm is initially disposed in the three o'clock position and the second torque arm is initially in the twelve o'clock position, the second weight member would sere to assist in the exercise motion from a minimum to maximum extent while the first weight member would serve to initially increase the resistance force and would provide a decreasing resistance during the exercise motion.

Accordingly, the present invention provides a weight lifting exercise apparatus in which the segments of maximum and minimum resistance force may be varied almost infinitely. As this invention provides a wide range of variations in the resistance force during the exercise motion, the user may develop precisely those muscles desired. In addition, this invention provides an easy to use means for varying exercise resistance force.

These and other details, objects and advantages of this invention will become apparent as the following description of the present preferred embodiments thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 2:
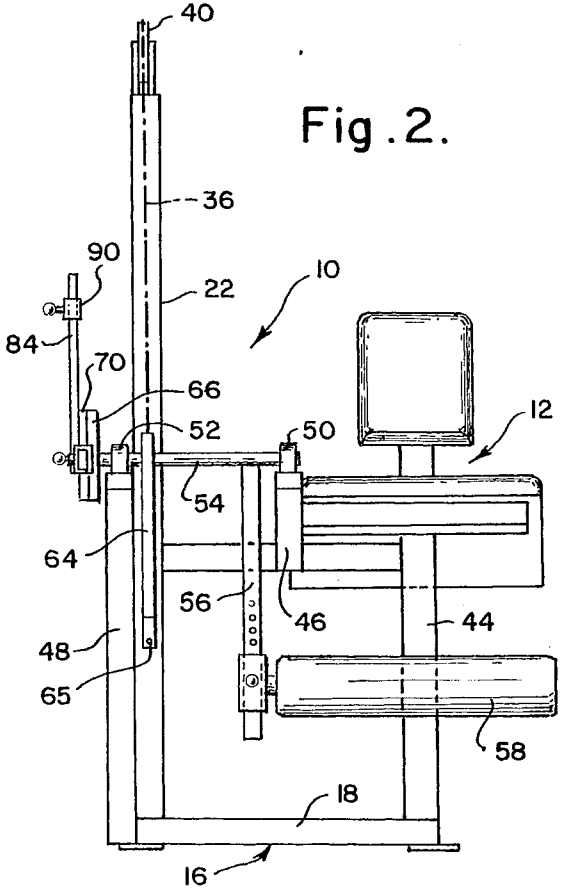
FIG. 2 is a front elevation view of the subject invention.
Figure 1:
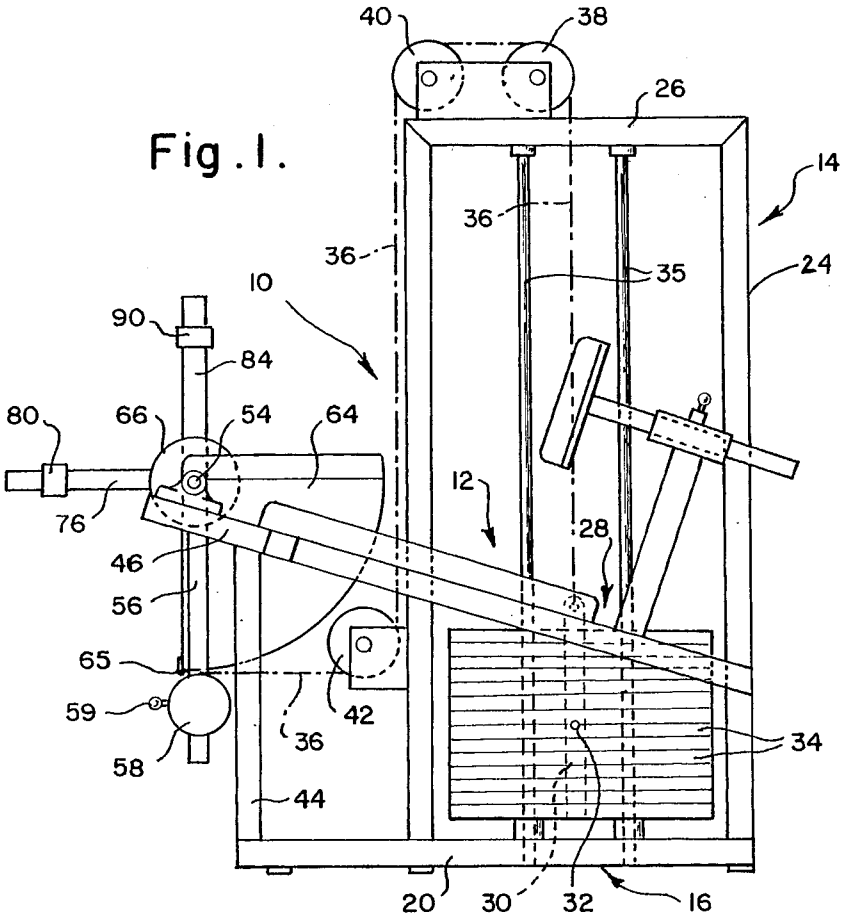
FIG. 1 is a side elevation view of the apparatus according to the present invention.
Figure 4:
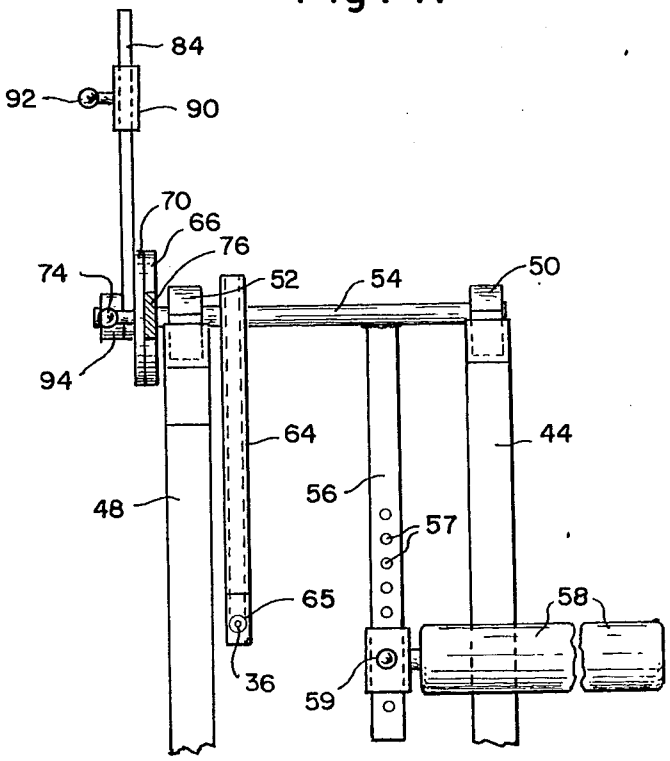
FIG. 4 is a detailed front elevation view of the instant invention.

Referring now to the drawings wherein the showings are for purposes of illustrating the present preferred embodiments of the invention only and not for purposes of limiting same, the Figures show a weight lifting exercise apparatus 10 having an exercise station 12 which may be occupied by a user.

The exercise apparatus 10 includes a main framework 14 which includes a base 16 consisting of lateral base frame members 18 and longitudinal frame members 20 suitable for support on a floor surface. The framework 14 also includes parallel forward and rear vertical frame members 22 and 24, respectively, which support an upper longitudinal frame member 26. Disposed within the framework 14 is a weight support carriage 28 which includes a plunger bar 30 having apertures along its length for receiving a pin 32 which may be disposed beneath a selected number of weight plates 34 in known manner to establish a base resistance force. The vertical movement of weight plates 34 is guided by vertical guide bars 35.

The upper end of the plunger bar 30 is connected to one end of a length of cable, shown as 36, which is reeved about first and second pulleys, 38 and 40, respectively, which are rotatably mounted on upper frame member 26. Cable 36 is also reeved around a third pulley 42 rotatably mounted on the lower portion of front vertical frame member 22.

The framework 14 also includes a foremost vertical frame member 44 which may support the leading end of a first bar member 46 of exercise station 12 in a predetermined orientation. A second bar member 48 is preferably attached to the front vertical frame member 22 parallel to the first bar member 46. The first bar member 46 supports a first pillow block 50 or similar bearing means. Additionally, the second bar member 48 supports a second pillow block 52. Rotatably supported by first pillow block 50 and second pillow block 52 is a rotatable shaft 54. Radially attached to rotatable shaft 54 is a bracket 56 which supports a bearing member 58 which is engaged by the user during the exercise motion and whose position may be varied along bracket 56 by means of a pop pin 59 which may engage apertures 57 in bracket 58. For example, bearing member 58 may comprise a horizontal padded cylindrical member which is engaged by a user for rotation about the shaft 54 in what is typically referred to as a leg extension exercise. Also, radially attached to shaft 54 by means of a first bracket 60 and a second bracket 62 is a cable wheel 64 which consists of a circular arc member having a groove about its circumferential surface. The arc length of cable wheel 64 is typically between 90° and 120° which is the range of movement for most exercise apparatuses. The other end of cable 36 is attached to one end of cable wheel 64 by an attachment bolt 65 in order that the cable 36 may be taken up along the groove when the cable wheel 64 is rotated during the exercise motion.

While the first and second cable wheel brackets, 60 and 62, respectively, and the bearing member support bracket 56 are attached to the shaft 54 intermediate the first and second pillow blocks 50 and 52, respectively, a fixed disk member 66 is attached to shaft 54 outboard from second pillow block 52. Fixed disk member 66 is provided with a plurality of apertures 67 spaced at a predetermined radius within its peripheral edge. Rotatably supported on shaft 54 adjacent to fixed disk 66 by means of a bearing 68 is a first movable disk 70. First disk 70 also has a plurality of apertures 72 spaced at a predetermined radius within its peripheral edge. A spring biased pop pin 74 is attached on the surface of first disk 70 and includes a pin member which may pass through one aperture 72 in first disk 70 and into apertures 67 on fixed disk 66 to fix the position of first disk 70 on shaft 54 relative to fixed disk 66.

A first torque arm 76 is radially secured to the circumferential edge of first disk 70. Apertures 78 are provided along the length of first torque arm 76. A first weight member 80, such as of twenty (20) pounds, is slidably supported on the first torque arm 76 and includes a pop pin 82 which has a pin which may engage an aperture 78 to fix the position of first weight member 80 relative to first torque arm 76. Accordingly, the position of first weight member 80 along first torque arm 76 establishes the moment arm through which first weight member 80 acts on shaft 54 and, hence, the intensity of first weight member 80 realized by the user.

In addition, a second torque arm 84 is rotatably supported on shaft 54 adjacent to first disk 70 by means of a bearing 86. Second torque arm 84 is provided with a plurality of apertures 88 along its length. A spring biased pop pin 89 is attached to the surface of second torque arm 84 which may pass through one aperture 88 therein and into apertures 72 on first disk 70 to fix the position of second torque arm 84 on shaft 54 relative to first disk 70. A second weight member 90, which may also be, for example, twenty (20) pounds, is slidably attached to second torque and 84 by means of a pop pin 92 whose pin may engage any of the apertures 88 to fix the position of second weight member 90 relative to second torque arm 84 and thereby establish the moment arm through which second weight member 90 acts on shaft 54. A collar 94 having a setscrew 96 is provided on shaft 54 adjacent to second torque arm 84 to prevent second torque arm 84 and first disk 70 from sliding off of shaft 54.

As noted above, resistance force will be taken to mean that force which must be overcome by the user in completing the initial one-half of the exercise motion. Hence, the resistance force will be that force which must be applied to the bearing member 58 to rotate shaft 54. Accordingly, a positive moment force applied to shaft 54 will assist the user in displacing shaft 54 while a negative moment force will add to the resistance force.

Figure 3:
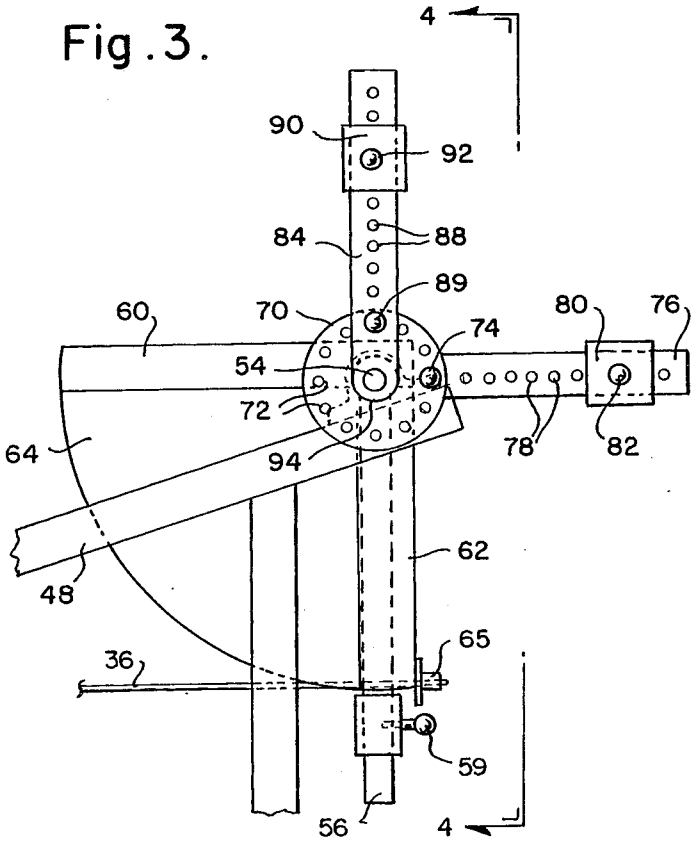
FIG. 3 is a detailed opposite side elevation view of certain components of the invention.
Figure 5:
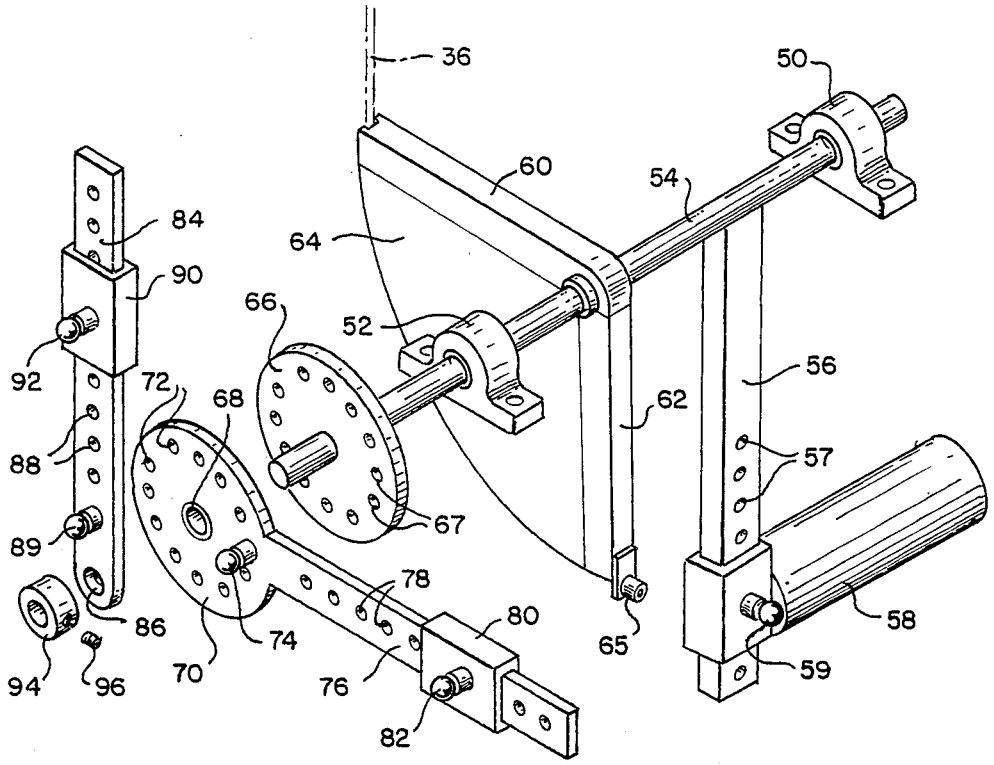
FIG. 5 is an exploded perspective view of certain elements of the apparatus according to this invention.

It will be appreciated that the position of first weight 80 along first torque arm 76 serves to establish the maximum length of the moment arm through which first weight 80 acts on shaft 54. In addition, the initial position of first torque arm 76 serves to define the position of the arc traversed by the first weight 80. Of course, such statements apply equally to the position of second weight 90 and the initial position of second torque arm 84. As such, when the first torque arm 76 and the first weight 80 are in the initial positions shown in FIG. 3, and the shaft 54 and, hence, the cable wheel 64 are rotated in a counterclockwise direction as shown therein, the first weight 80 acts to apply a negative moment force of decreasing magnitude to shaft 54 thereby adding, by a decreasing amount, to the force resisting shaft 54 rotation provided by weight support carriage 28 to, in effect, apply a decreasing amount of additional resistance force to the shaft 54. As the shaft 54 is rotated 90°, the negative moment force created by first weight 80 reaches its minimum; as the shaft 54 is rotated further, the first weight 80 serves to create an increasingly positive moment force. Correspondingly, when the second torque arm 84 and the second weight member 90 are disposed in the initial positions shown in FIG. 3, and the shaft 54 and, hence the cable wheel 64 are rotated in a counterclockwise direction, the second weight 90 will initially have no effect on the resistance forces but, as they are displaced, the second weight 90 will exert an increasingly positive moment force on the shaft 54 to assist the exercise motion by counteracting a portion of the resistance force of the weight support carriage 28 and of the first weight 80. Again, as the shaft 54 is rotated 90° the positive moment force will reach its maximum at the three o'clock position. It will, of course, be appreciated that the moment forces provided by the first weight 80 and the second weight 90 will be cumulative to provide a net impact on the exercise movement which varies substantially from the resistance forces provided by weight support carriage 28 alone.

Figure 6:
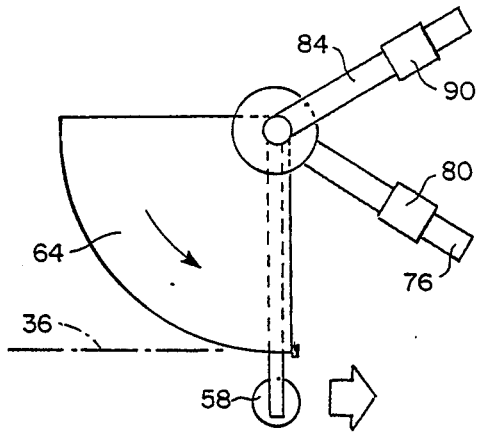
FIG. 6 is a side elevation schematic representation of the operation of the present invention.

Of course, the initial positions of the first torque arm 76, the first weight member 80, the second torque arm 84 and the second weight member 90 may be varied throughout the myriad of positions permitted by the pop pins 74, 82, 89 and 92, respectively, and the corresponding apertures they may engage. For example, with reference now to FIG. 6, if the first torque arm 76 is initially disposed in the four o'clock. position and the second torque arm 84 is in the two o'clock position, the first weight member 80 and the second weight member 80 will initially create negative moment forces which serve to increase the effective resistance force. As the shaft 54 is rotated 90°, the first weight 90 will create an increasingly negative moment force until it reaches the three o'clock position and then will create a decreasingly negative moment force. Simultaneously, the second weight 90 will create a decreasingly negative moment force until it reaches the twelve o'clock position and then it will create an increasingly positive moment force throughout the remainder of the exercise movement. Again, when the effects of the first and second weight members 80 and 90, respectively, are combined, the resistance force experienced by the user will serve to provide a lengthened segment of maximum resistance force throughout a substantial portion of the exercise movement.

Figure 7:
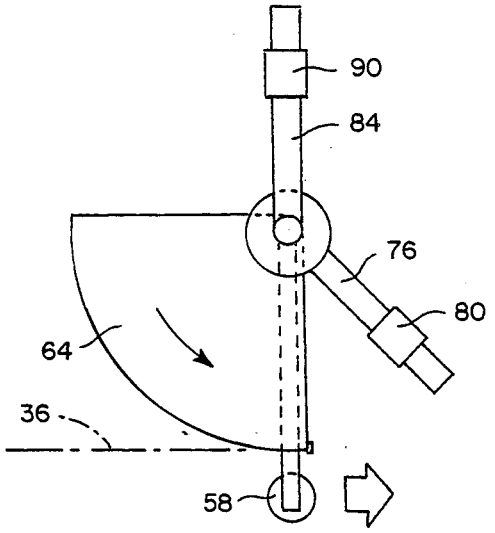
FIG. 7 is a side elevation schematic representation of an alternative operation of this invention.

Another example of the beneficial effects of the variable resistance forces provided by this invention is depicted in FIG. 7 wherein the first torque arm 76 is disposed in the four o'clock position and the second torque arm 84 is in the twelve o'clock position. Again, as the shaft 54 is rotated counterclockwise approximately 100° during the exercise motion, the first weight member 80 will initially create a negative moment force which will be increasingly negative until the first torque arm 76 reaches the three o'clock position. Thereafter, the first weight will create a decreasingly negative moment force. Simultaneously, the second weight 90 will create an increasingly positive moment force until it reaches the nine o'clock position at which point it will create a decreasingly positive moment force throughout the remainder of the exercise movement.

Figure 8:
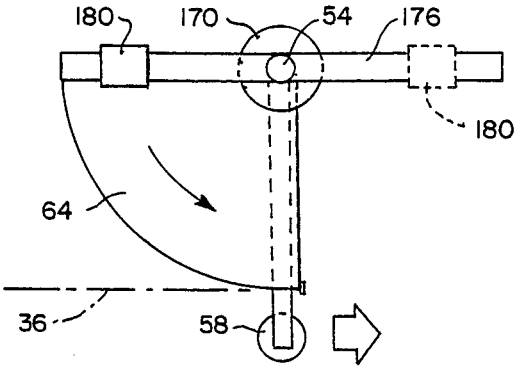
FIG. 8 is a side elevation schematic representation of an alternative embodiment of this invention.

An alternative embodiment of the present invention is depicted in FIG. 8 wherein like reference numerals refer to like elements in the preceding embodiment of the invention. In this embodiment, the first torque arm 176 comprises an elongated torque arm pivotally supported at its center by the first disk 170 on the shaft 54 and extends radially to both sides thereof. Correspondingly, the second torque arm 84 is eliminated. In this embodiment, the first weight member 180 is slidably mounted on first torque arm 176 such that it may be moved from one side thereof to the other. Also, the first weight member 180 is preferably of a greater weight than first or second weight members, 80 or 90, respectively, such as thirty (30) pounds. In operation, the first disk 170 is adjustably fixed relative to fixed disk 66 and the position of first weight member 180 is selected. When the first weight member 180 is initially in the nine o'clock position shown in solid lines on FIG. 8 and the shaft 54 is rotated 100°, the weight member 180 creates a decreasingly positive moment force through it reaches the six o'clock position, at which point it begins to create an increasingly positive moment force until the remainder of the exercise movement. If, on the other hand, the first weight member 180 is initially in the position shown in dotted lines in FIG. 8, it will create a decreasingly negative moment force until it reaches the twelve o'clock position at which point it will create an increasingly positive moment force. Of course, the first torque arm 176 may be disposed in a plurality of initial positions relative to fixed disk 66.

It will also be appreciated that more than two (2) torque arms may be provided along with corresponding disk members to allow their positions to be predetermined relative to adjacent disk members. In such an embodiment, even greater flexibility in establishing segments of maximum and minimum resistance force is afforded.

As such, the present invention provides a weight lifting exercise apparatus which has the capability of providing a myriad of different segments of maximum and minimum resistance force. Because of its flexibility, the apparatus disclosed herein is well suited for muscle development. It is also anticipated that the apparatus disclosed herein will be most useful in exercises for the rehabilitation of damaged muscles. In fact, this apparatus may be employed with or without connection to the weight support carriage 28, for example, in rehabilitation settings were only a minimum amount of resistance force is appropriate.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Weight lifting exercise apparatus comprising:

a. a support frame;

b. weight support carriage means vertically movable within said support frame for detachably securing a plurality of weight members;

c. cable guide means fixed to said support frame above said weight support carriage means;

d. a cable segment means secured at one end to said weight support carriage means and extending through said cable guide means;

e. a horizontal shaft rotatably supported on said frame;

f. a bearing member attached to said shaft for engagement by a user to rotate said shaft;

g. a cable wheel rotatably mounted on said shaft and having a circumferential arc surface with the other end of said cable segment means attached to said cable wheel such that the rotation of said cable wheel causes said cable segment means to engage said circumferential arc surface to transmit force to said cable segment means to transmit vertical movement force to said weight support carriage means;

h. a first radial torque arm rotatably mounted on said shaft;

i. means for adjustably and non-rotationally coupling said first torque arm to said shaft at any of a plurality of radial positions; and j. a first weight member supported on said first torque arm.

2. Apparatus of claim 1 in which said means for coupling said first torque arm to said shaft comprises:

a. a fixed disk attached at its axis to said shaft;

b. a first disk mounted for rotation about its axis on said shaft adjacent to said fixed disk, wherein said first torque arm is radially mounted on said first disk; and c. means for coupling said first disk to said fixed disk.

3. Apparatus of claim 1 further comprising:

a. a second radial torque arm rotatably mounted on said shaft adjacent to said first disk;

b. means for coupling said second torque arm to said first disk; and c. a second weight member supported on said second torque arm.

4. Apparatus of claim 3 further comprising means for adjustably attaching said first weight member at a predetermined point along the length of said first torque arm.

5. Apparatus of claim 4 further comprising means for adjustably attaching said second weight member at a predetermined point along the length of said second torque arm.

6. Apparatus of claim 5 in which said means for coupling said first disk to said fixed disk comprises:

a. a first plurality of apertures each provided through said fixed disk at a predetermined radius;

b. a second plurality of apertures each provided through said first disk at said predetermined radius; and c. pin means for coupling one of said first plurality of apertures to one of said second plurality of apertures.

7. Apparatus of claim 6 in which said means for coupling said second torque arm to said first disk comprises:

a. a primary aperture through said second torque arm at said predetermined radius; and b. pin means for coupling said primary aperture to one of said second plurality of apertures.

8. Apparatus of claim 1 in which said first torque arm is pivotally mounted intermediate its ends on said shaft and said first weight member may be supported on said first torque arm on either side thereof relative to said shaft.

9. Apparatus of claim 8 in which said first weight member is mounted on said first torque arm for sliding movement along said first torque arm and for attachment at a predetermined point therealong.

10. Weight lifting exercise apparatus comprising:

a. a support frame;

b. a horizontal shaft rotatably mounted on said frame;

c. a bearing member attached to said shaft for engagement by a user to rotate said shaft;

d. a fixed disk attached at its axis to said shaft;

e. a first disk mounted for rotation about its axis on said shaft adjacent to said fixed disk;

f. a first radial torque arm mounted on said first disk;

g. a first weight member supported on said first torque arm for adjustable attachment along the length of said first torque arm;

h. means for coupling said first disk to said fixed disk in a predetermined position, comprising:

(1) a first plurality of apertures each provided through said fixed disk at a predetermined radius;

(2) a second plurality of apertures each provided through said first disk at said predetermined radius; and (3) pin means for coupling one of said first plurality of apertures to one of said second plurality of apertures;

i. a second radial torque arm rotatably mounted on said shaft adjacent to said first disk;

j. a second weight member supported on said second torque arm for adjustable attachment along the length of said second torque arm;

k. means for coupling said second torque arm to said first disk, comprising:

(1) a primary aperture through said second torque arm at said predetermined radius; and (2) pin means for coupling said primary aperture to one of said second plurality of apertures.

11. Apparatus of claim 10 further comprising:

a. weight support carriage means vertically movable within said support frame for detachably securing a plurality of weight members;

b. cable guide means fixed to said support frame above said weight support carriage means;

c. a cable segment means secured at one end to aid weight support carriage means and extending through said cable guide means; and d. a cable wheel rotatably mounted on said shaft and having a circumferential arc surface with the other end of said cable segment means attached to said cable wheel such that the rotation of said cable wheel causes said cable segment means to engage said circumferential arc surface to transmit force to said cable segment means to transmit vertical movement force to said weight support carriage means.

12. Apparatus of claim 10 in which said first torque arm is pivotally mounted intermediate its ends on said shaft and said first weight member may be supported on said first torque arm on either side thereof relative to said shaft.

13. Apparatus of claim 12 in which said first weight member is mounted on said first torque arm for sliding movement along said first torque arm and for attachment at a predetermined point therealong.

* * * * *